US010927573B2

(12) United States Patent
Och et al.

(10) Patent No.: US 10,927,573 B2
(45) Date of Patent: Feb. 23, 2021

(54) DOOR LOCK OPERATOR HAVING DIFFERENT TYPES OF DOOR LOCK OPERATION

(71) Applicant: ILLINOIS TOOL WORKS INC., Glenview, IL (US)

(72) Inventors: Roland Och, Rottendorf (DE); Zsolt Wilke, Bad Mergentheim (DE); Andreas Rudolf, Würzburg (DE); Martin Weid, Gollhofen (DE)

(73) Assignee: ILLINOIS TOOL WORKS INC., Glenview, IL (US)

( * ) Notice: Subject to any disclaimer, the term of this patent is extended or adjusted under 35 U.S.C. 154(b) by 529 days.

(21) Appl. No.: 15/579,474

(22) PCT Filed: Jun. 6, 2016

(86) PCT No.: PCT/US2016/036091
§ 371 (c)(1),
(2) Date: Dec. 4, 2017

(87) PCT Pub. No.: WO2016/200743
PCT Pub. Date: Dec. 15, 2016

(65) Prior Publication Data

US 2018/0148957 A1 May 31, 2018

(30) Foreign Application Priority Data

Jun. 8, 2015 (EP) ..... 15171041
Feb. 9, 2016 (EP) ..... 16154945

(51) Int. Cl.
*E05B 85/10* (2014.01)
*E05B 81/76* (2014.01)

(52) U.S. Cl.
CPC ..... *E05B 85/107* (2013.01); *E05B 81/76* (2013.01); *E05B 85/103* (2013.01); *Y10T 292/57* (2015.04)

(58) Field of Classification Search
CPC ..... E05B 81/76; E05B 85/103; E05B 85/107; Y10T 292/57
See application file for complete search history.

(56) References Cited

U.S. PATENT DOCUMENTS 3,993,338 A * 11/1976 Cherbourg ..... B60J 5/06 292/336.3
3,993,339 A * 11/1976 Cherbourg ..... E05B 5/00 292/336.3

(Continued)

FOREIGN PATENT DOCUMENTS

CN 104066914 A 9/2014
DE 4002963 7/1991

(Continued)

OTHER PUBLICATIONS

PCT, International Search Report and Written Opinion, International Application No. PCT/US2016/036091; dated Sep. 15, 2016, 10 pages.

*Primary Examiner* — Carlos Lugo
(74) *Attorney, Agent, or Firm* — Thompson Hine LLP

(57) ABSTRACT

A door lock operator (1) for a motor vehicle door (100) includes a first switch (10) and a first pivot arm (30) mounted so as to be pivotable about a first rotation axis (21.1) of a first articulation (21) along a first degree of freedom (31), wherein the first pivot arm (30) has a further degree of freedom (32) which is substantially perpendicular to the first rotation axis (21.1), and the first switch (10) is operable by way of movement of the first pivot arm (30) along a first direction of the further degree of freedom (32), wherein the first switch (10) is provided to be connected by (Continued)

Figure 1A:
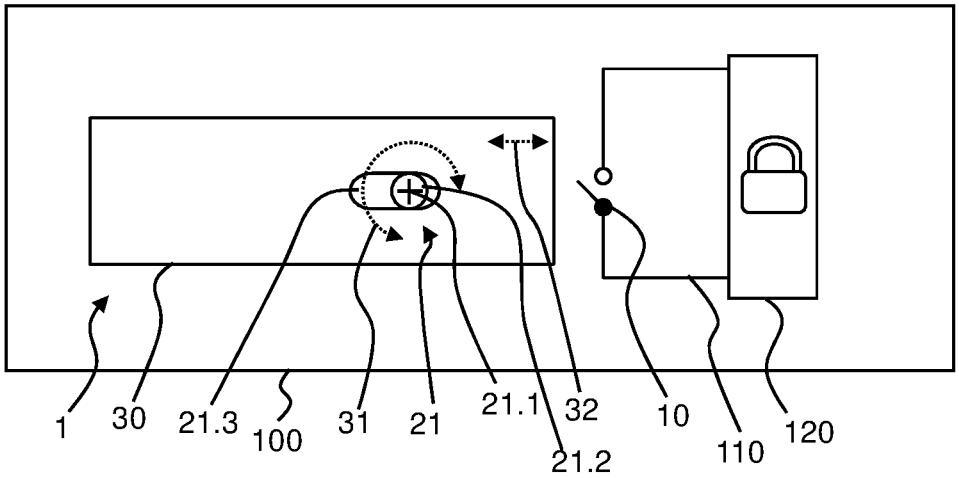

way of a signal line (110) to an electric door lock (120) such that the electric door lock (120) is operable by the first switch (10).

18 Claims, 8 Drawing Sheets

(56) References Cited

U.S. PATENT DOCUMENTS 4,889,373 A * 12/1989 Ward ..... E05B 13/002 292/336.3
5,123,687 A * 6/1992 Pfeiffer ..... E05B 1/0092 292/336.3
5,685,581 A * 11/1997 Kritzler ..... E05B 85/16 292/336.3
5,844,470 A * 12/1998 Garnault ..... E05B 81/20 340/5.62
6,072,403 A * 6/2000 Iwasaki ..... G07C 9/00309 180/287
6,181,024 B1 * 1/2001 Geil ..... E05B 85/10 180/287
6,698,262 B2 * 3/2004 Wittwer ..... E05B 85/107 292/336.3
7,005,959 B2 * 2/2006 Amagasa ..... E05B 81/78 307/10.1
7,364,211 B2 4/2008 Niskanen
7,556,033 B2 7/2009 Kim
7,763,816 B2 * 7/2010 Buschmann ..... E05B 81/76 200/302.1
8,342,583 B2 * 1/2013 Stauffer ..... E05B 81/76 292/1
8,505,241 B2 * 8/2013 Kusunoki ..... E05B 81/76 49/360
8,540,293 B2 * 9/2013 Muller ..... E05B 85/16 292/336.3
8,690,204 B2 * 4/2014 Lang ..... E05B 81/77 292/279
8,991,227 B2 * 3/2015 Muller ..... E05B 85/107 292/336.3
9,797,172 B2 * 10/2017 Kammerbauer ..... E05B 85/16
2001/0005082 A1 * 6/2001 Suparschi ..... E05B 85/18 292/347
2002/0108310 A1 * 8/2002 Schroer ..... E05F 15/00 49/280
2005/0248163 A1 11/2005 Kim
2010/0192648 A1 8/2010 Stauffer
2017/0306662 A1 * 10/2017 Och ..... E05B 81/78

FOREIGN PATENT DOCUMENTS

DE 4039442 C1 1/1992
DE 102008019335 A1 * 10/2008 ..... E05B 85/107
DE 20 2009 010746 11/2009
EP 1644665 B1 11/2014
EP 3020896 5/2016
FR 2958962 10/2011
GB 2477085 7/2011

* cited by examiner

DOOR LOCK OPERATOR HAVING DIFFERENT TYPES OF DOOR LOCK OPERATION

The invention relates to a door lock operator for electrically operating a door lock.

EP14192841.4, which at the time of application has not been published, relates to a push-button device which may be considered to be such a door lock operator. The construction requires, as is intended therein, that the operation element therein which is operated by the user in order to operate the door lock is substantially spatially stationary, door lock operation being achieved substantially in one manner.

In another context, specifically in a combination of an electric window opener and a mechanical door handle, DE 20 2009 010 746 U1 relates to a vehicle door having a manually operable handle which from a standby position is pivotable about at least one pivot axis, at least part of the handle having at least one further degree of freedom wherein by movement of at least part of the handle, according to the further degree of freedom, the electrical operating installation of the window is operable. The door here may be opened only in a mechanical manner.

Proceeding from the first-mentioned push-button device it has been the object of the present invention to provide various possibilities of operating a door lock, including at least one electrical variant, having only one door lock operator. The object is achieved by the independent claims. Advantageous refinements are defined in the dependent claims.

The object is achieved in particular by a door lock operator for a motor vehicle door, wherein the door lock operator has a first switch and a first pivot arm which is mounted or mountable so as to be pivotable, preferably with respect to the motor vehicle door or an operation element described in more detail further below, about a first rotation axis of a first articulation along a first degree of freedom, wherein the first pivot arm has a further degree of freedom which is substantially perpendicular to the first rotation axis, and the first switch is operable by way of movement of the first pivot arm along a first direction of the further degree of freedom, the first switch being provided to be connected by way of a signal line to an electric door lock such that the electric door lock is operable by the first switch. A further achievement of the object lies in the use of a door lock operator in the motor vehicle door, for operating the door lock of the motor vehicle door by means of the switch.

The object is furthermore achieved in particular by a motor vehicle door system having a motor vehicle door and having a door lock operator according to the invention, and having a door lock, wherein the motor vehicle door system has a signal line which connects the first switch to the electric door lock, or by a motor vehicle having such a motor vehicle door system.

The object is furthermore achieved in particular by the use of a door lock operator according to the invention in a motor vehicle door system or a motor vehicle, wherein the first switch is used for operating an electrical door lock.

On account thereof, higher flexibility in the operation of the door lock operator is achieved. On the one hand, there is a pivot arm which may be used in a direct or indirect manner for the electrical or mechanical operation of the door lock, or which may be utilized for a more complex operation via a gear box (for example, in two different pivoted states); moreover, there is electronic operation of the door lock along the further degree of freedom by means of the switch.

A switch is preferably understood to be an electromechanical assembly which is specified for generating an electrical switching signal, this particularly preferably being a microswitch, for example. However, sensor-supported switch assemblies having a sensor (a Hall-effect sensor, for example) and an evaluation unit (a microcontroller, a comparator, for example) are also conceivable. Operation of the switch is preferably understood to mean rendering the switch from a switching state to the other switching state.

Movement of the first pivot arm along a direction of the further degree of freedom is preferably understood to be movement by a movement component along this direction. The further degree of freedom is preferably a purely linear degree of freedom.

A signal line is preferably a line for transmitting a switching signal, either physically in a line-bound manner or as a wireless signal. The signal line is a cable or a wireless connection, for example. The signal line here may comprise various nodal points or (digital or analog) transferring/conditioning/processing points, for example a central controller unit, as well as portions having various transmission media.

"Substantially perpendicular" in the context of this application is ideally understood to be an angle of 90°; however, there may typically be a certain tolerance range of preferably less than ±40°, particularly preferably less than ±20°, most particularly preferably less than ±5°.

Operation of the door lock is understood to be, for example, opening/closing of the door latch and/or locking/unlocking.

Use of the ordinal number "first" in the independent claim is merely offered in order for the components to be more readily differentiated with a view to further components being mentioned in preferred embodiments and does not imply that a further respective component has to be axiomatically present.

In a further exemplary embodiment of the present invention, the first pivot arm along at least a part-region of the first degree of freedom is (directly or indirectly) impinged by a first spring element.

On account thereof, the further degree of freedom is reduced at least for low adjustment forces which act on the pivot arm such that the switch is operated only when intentional adjustment along the further degree of freedom is to take place, a targeted force being applied to the pivot arm. Moreover, superfluous play may thus be avoided.

The spring element is a leaf spring, for example, particularly preferably a catch spring, the latter by virtue of its non-linear characteristic curve being particularly suitable since said spring up to a comparatively high force has no significant deformation but then may be abruptly deformed using a lower force. A very good threshold value for operating the switch or the switches, respectively, may thus be achieved such that the first articulation does not "wobble" already at minor adjustment forces, but is also not too hard to operate (as would be the case with a rigid spring based on Hooke's law). The spring element is particularly preferably coupled to the first switch.

In one further exemplary embodiment of the present invention, the first switch is also operable by way of pivoting the first pivot arm along a first direction of the first degree of freedom.

On account thereof, the switch may be operated by way of two different movements, which may be utilized in different ways. For example, the lock may be electronically locked or unlocked by depressing the pivot arm in the standby position (first operation of the switch), then electronically operating the lock latch by tractioning (pivoting) the first pivot arm. Preferably, the first pivot arm has an eccentric contour, or a protrusion, or a notch, preferably in the region of the first articulation, by means of which the pivoting movement is converted to a linear operation movement of the switch. Beyond a predefined angle, this eccentric contour, or the protrusion, or the notch, causes the switch to switch.

In one further exemplary embodiment of the present invention, the first articulation has an axle element which is guided so as to be traversable in an elongate bore.

On account thereof, the further degree of freedom is defined in a targeted manner in a direction with is transverse to the first rotation axis of the first articulation. The axle element is preferably disposed so as to be coaxial with the first rotation axis. Said axle element is a pin or a plug, for example. The axle element here may be guided in the elongate bore directly (in that a region of the axle element is directly plug-fitted in the elongate bore, for example) or indirectly (in that the axle element is disposed on a mounting or has another mounting region, this mounting or the mounting region being guided so as to be traversable in the elongate bore, for example). Either, the axle element is rotatable in the elongate slot.

Alternatively, the axle element may be disposed so as to be rotationally fixed in relation to the elongate bore, the first pivot arm being rotatably mounted on the axle element. "Traversably guided" is in particular understood to be any guide in which the elongate bore and the axle element are mutually traversable, regardless of whether the axle or the elongate bore is considered to be the fixed point. As can also be seen later from the exemplary embodiments shown in the figures (for example, in FIGS. 1*a*, 1*b*, 3*a-d*, 4*a-c*), this may therefore also be understood to mean that the axle element is locationally fixed (in relation to the vehicle door, for example), while the elongate bore (provided on the first pivot arm, for example) is movable with the first pivot arm, or it may be understood to mean that the elongate bore is locationally fixed (in relation to the vehicle door, for example), the axle being fixed or rotatable only in relation to the first pivot arm, as is shown in FIGS. 2*a*-2*f*, for example.

In one further exemplary embodiment of the present invention, the first articulation has a pivot arm sided part and a motor vehicle door sided part, the elongate bore being present in the motor vehicle door sided part.

On account thereof, an optimal rotating connection between the pivot arm and the axle element can be maintained since the further degree of freedom is not defined by the same element (the axle element) which also establishes the rotating connection; rather, the degree of freedom is established by traversing the axle element per se. A pivot arm part sided is an articulated part on the side of the pivot arm; a motor vehicle door sided part is an articulated part on the side of the motor vehicle door. Preferably, the pivot arm sided part and themotor vehicle door sided part are interconnected by the axle element. Preferably, the first articulation has an axle element which is disposed so as to be rotationally fixed yet linearly traversable in the elongate bore. Preferably, the first pivot arm, for example by way of an actuator, is torsioned by means of rotation of the axle element which is rotatably disposed in a housing.

In one further exemplary embodiment of the present invention, the axle element on one side of the axle element, preferably at one end or in a region close to an end or a region of the axle element close to the upper edge of the first pivot arm, is (directly or indirectly) guided in the elongate bore so as to be traversable in a manner substantially perpendicular to the first rotation axis and preferably so as to be rotatable, and on another side of the axle element, preferably at one end or in a region close to an end or a region of the axle element close to the lower edge of the first pivot arm, is mounted so as not to be traversable in relation to the first rotation axis along the first degree of freedom and preferably is rotatable in a preferably circular bore.

On account thereof, a pivoting movement between the one side of the axle element and the elongate bore along the further degree of freedom is achieved, while a connection which is mainly restricted to the degree of freedom of the first rotation axis (or even more restricted, depending on the design embodiment) is present on the other side of the axle element. This is advantageous, for example, if the pivot arm directly serves as an operation element, since in this instance parallel guiding of the entire first pivot arm along the further degree of freedom is not of importance (the user not requiring parallel movement for operation). In this case, it is more advantageous for the further degree of freedom to exist only in a specific region, particularly where the first switch is disposed. The term "not traversable in relation to the first rotation axis" includes a certain tolerance range (as play is typically present), that is to say that traversability along the further degree of freedom is at least less than traversability in the region of the elongate bore, preferably by a factor of 0.1, particularly preferably by a factor of 0.05.

In one further exemplary embodiment of the present invention, the axle element on one side of the axle element, preferably at one end or in a region close to an end or a region close to the upper edge of the first pivot arm, is guided (directly or indirectly) in the elongate bore so as to be traversable in a manner substantially perpendicular to the first rotation axis, and preferably so as to be rotatable, and on another side of the axle element, preferably at another end or in a region close to an end or a region close to the lower edge of the first pivot arm, is guided in a further or the same elongate bore (for example extending axially across at least 25%, preferably 50%, particularly preferably across an even greater percentage of the extent of the first pivot arm in the direction of the first rotation axis) so as to be traversable in a manner substantially perpendicular to the first rotation axis, and is preferably guided (directly or indirectly) so as to be rotatable.

On account thereof, parallel traversing of the first pivot arm along a direction of the further degree of freedom is advantageously provided, which is particularly expedient if and when the degree of freedom is to be utilized by way of a gear box. The elongate bores are preferably mutually parallel.

In one further exemplary embodiment of the present invention, the door lock operator has a further switch, and the further switch by way of movement of the first pivot arm is operable along the further degree of freedom in a second direction which is counter to the first direction.

On account thereof, two different switches are operable and utilizable for the operation of the door lock by two mutually opposite movements along the further degree of freedom, for example by locking in one direction, and unlocking in the direction counter thereto. Preferably, the pivot arm along at least one further part-region of the first degree of freedom is impinged (directly or indirectly) by a second spring element such that the first pivot arm in terms of the freedom of movement thereof in the one direction is restricted in a force-dependent manner by the first spring element, and in the other direction by the second spring element.

In one further exemplary embodiment of the present invention, the door lock operator has a stop which in a pivoted position of the first pivot arm restricts movement of the first pivot arm along the further degree of freedom more than in any other pivoted position of the first pivot arm.

On account thereof, operation of the door lock is restricted to a specific state in terms of the angular range of the pivot arm. The degree of restriction is preferably such that operation of the switch is impossible in the one pivoted position of the first pivot arm. For example, a stop which beyond a specific outwardly pivoted state blocks the further degree of freedom to the corresponding degree is present (this may be utilized, for example, in order to suppress operation when the user excessively operates the pivot arm), and/or a stop which beyond a specific inwardly pivoted state blocks the further degree of freedom (this may be utilized, for example, in order to suppress operation by rebounding of the pivot arm, for example by virtue of a reset spring) may be present. The stop is preferably a cam which is disposed on the pivot arm, for example, and at a specific angular position moves into an intermediate space in the elongate bore.

In one further exemplary embodiment of the present invention, the first switch is locationally fixed in relation to the first pivot arm.

On account thereof, operation by way of a gear box may be implemented in a particularly advantageous manner. By way of the locationally fixed arrangement, the switch is conjointly rotated with the pivot arm, the direction of movement operating the switch is thus constant in relation to the pivot arm and, to this extent, independent from the torsion angle of the pivot arm. Preferably, if and when a second switch is present, the second switch is also locationally fixed in relation to the first pivot arm.

In one further exemplary embodiment of the present invention, the door lock operator has a pivotably mounted transmission lever which impinges the first switch and which by pivoting the first pivot arm and/or by the movement of the first pivot arm along the first direction of the further degree of freedom is impingeable by the first pivot arm in such a manner that, on account thereof, the first switch is operable by means of the transmission lever.

On account thereof, further pressure points for operating the switch are enabled. The transmission lever is preferably specified for transmitting specific pivoting movements of the first pivot arm to the switch. Preferably, the transmission lever by way of a dedicated rotation axis which is aligned so as to be parallel with the rotation axis of the first articulation is likewise pivotably mounted. The first pivot arm and the transmission lever are preferably disposed so as to be reciprocal, that is to say that the transmission lever (at least in the standby position) extends from the rotation axis thereof substantially in the direction of the rotation axis of first articulation, the first pivot arm extending from the rotation axis of the first articulation substantially in the direction of the rotation axis of the transmission lever. The first pivot arm and the transmission lever are preferably mutually overlapping. Particularly preferably, the switch is operable by means of the transmission lever by inwardly pivoting the first pivot arm in the direction of the surface of the vehicle door.

In one further exemplary embodiment of the present invention, the door lock operator between the first pivot arm and the transmission lever has a transmission contact region in which the first pivot arm and the transmission lever bear on one another, wherein the transmission contact region has a spacing from an imaginary line through the first rotation axis the line being parallel or collinear with the further degree of freedom.

On account thereof, a pivoting movement of the first pivot arm is advantageously transmittable to the transmission lever. A spacing is preferably understood to mean that one or a plurality of regions in which there is no transmission contact lie between this line and the transmission contact region. A transmission contact region is preferably understood to mean a localized contiguous region of the respective component by way of which a pressure force is transmittable to the other component.

The first pivot arm is preferably urged against the transmission lever by means of a spring element.

Preferably, the transmission contact region lies between the rotation axis of the transmission lever and the rotation axis of the first rotary joint, particularly preferably so as to be approximately centric therebetween, for example half-way along a connection line which is perpendicular through both the axes; by providing the transmission contact region in this manner, half-way between the axes, advantageous uniformity of the required pressure force along the pressure area is achieved or approximated. The transmission lever preferably has a protrusion, in order for the transmission contact region to be defined.

The door lock operator between the first pivot arm and the transmission lever preferably has a further transmission contact region which lies on or in direct proximity of the imaginary line through the first rotation axis that is parallel or collinear with the further degree of freedom, such that there are two mutually spaced apart transmission contact regions. Spaced apart preferably means being mutually separated by regions in which there is no contact between the first pivot arm and the transmission lever. The second contact region here is thus preferably formed so as to be level in height with the first articulation.

In one further exemplary embodiment of the present invention, the first pivot arm has an operation portion which is to be manually pulled or to be manually depressed, and which at the same time is therefore an operation element.

On account thereof, a simple construction is provided by means of which two different types of operation are possible by means of tractioning or depressing the first pivot arm such that movement along the first degree of freedom results (which is routed to the door lock by means of a Bowden cable, for example), and by means of depressing (or tractioning) the pivot arm in the region of the first articulation such that the switch is operated by movement along a direction of the further degree of freedom.

In one further exemplary embodiment of the present invention, the door lock operator has an operation element having an operation portion which is to be manually gripped or to be manually depressed, and a second articulation, the operation element by way of the second articulation being mounted on the first pivot arm, or the operation element by way of the first articulation being mounted on the first pivot arm, thus providing pivotability of the first pivot arm along the first degree of freedom about the first rotation axis in relation to the operation element, and the first pivot arm by way of the second articulation being directly or indirectly mounted or mountable on the motor vehicle door.

On account thereof, a type of operation which in terms of construction is more complex yet more appealing to the user is implementable. The second articulation is preferably a rotary joint. The latter preferably has a rotation axis which is substantially parallel with the first rotation axis.

In one further exemplary embodiment of the present invention, the door lock operator has a second pivot arm which by way of a third articulation is mounted or mountable so as to be pivotable in relation to the motor vehicle door, and wherein the operation element by way of a fourth articulation is mounted on the second pivot arm.

On account thereof, the operation element is traversable in a parallel and guided manner. The third and the fourth articulation are preferably rotary joints. The rotation axes of the latter are preferably parallel with the first rotation axis. The four articulations preferably form a four-bar linkage or a parallelogram linkage, respectively. Here, the axes of the first and of the third articulation in relation to the vehicle door are preferably locationally fixed.

In one further exemplary embodiment of the present invention, the first pivot arm along the further degree of freedom is traversable preferably in a bidirectional manner by means of a rotation movement of the operation element that is performed about the fourth articulation.

On account thereof, the fourth rotary joint serves as a fixed point about which the operation element is pivotable such that the first pivot arm by depressing or tractioning the operation element may be traversed along the further degree of freedom. To this end, the fourth rotary joint in the position thereof in relation to the door is at least temporarily locationally fixed.

In one further exemplary embodiment of the present invention, the operation element on either side of the fourth articulation has at least one operation area.

On account thereof, solely by way of a type of operation area (pressure area or traction area), rotation about the fourth rotary joint may be achieved in one or the other direction (depending on which operation area has been depressed). The first pivot arm by way of one type of operation (depressing or tractioning) may thus be traversed in two opposite directions along the further degree of freedom, two different switches (the first switch and the further switch) thus being able to be operated. The operation areas on either side of the fourth articulation are preferably pressure areas, preferably exclusively pressure areas. This is very advantageous, for example, when the operation element terminates so as to be flush with the surface of the vehicle door, and only depressing is to be possible.

In one further exemplary embodiment of the present invention, the operation element manually and/or by means of an actuator is alternatable between two positions, preferably by way of parallel traversing.

On account thereof, two different operation situations are provided for the user. Here, the operation element along the first degree of freedom of the first pivot arm is preferably alternatable between the two positions. Preferably, the one position is a position wherein the operation element is retracted into the motor vehicle door. Here, the external face (visible face) of the operation element terminates so as to be flush or at least largely flush with the surface (visible face) of the motor vehicle door. The other position is preferably a position projecting from the motor vehicle door, at least one traction area for the user for operating the door lock operator and/or as an access area for pivoting open the motor vehicle preferably being provided in a preferably complete manner in this projecting position. Particularly preferably, in the projecting position, a rear wall of the operation element that faces the user terminates so as to be flush with the surface of the motor vehicle door. The actuator is an electromechanical actuator, for example, which is coupled to one of the pivot arms or to the operation element, particularly preferably to the second pivot arm.

In one further exemplary embodiment of the present invention, the further degree of freedom of the first pivot arm in both these positions is present in a preferably bidirectional manner, preferably so as to be utilizable by the user.

On account thereof, the switch may be operated by movement of the first pivot arm along the further degree of freedom in both positions.

In one further exemplary embodiment of the present invention, the operation element has a pressure area which is to be manually depressed, wherein the operation element by manual pressure on this pressure area is manually pivotable from one of these two positions, the one of these two positions being a standby position of the operation element.

On account thereof, the operation element just by manual pressure (for example, when traction areas are not accessible or are not comfortably accessible) may be moved from the standby position to a position in which the former projects from the surface of the vehicle door, for example. The respective pressure area, when viewed in particular from an operation portion of the operation element to be pulled, for example a handle portion, is preferably disposed beyond the first articulation, that is to say that the rotary joint geometrically separates a handle portion or a portion of the operation element that is to be pulled from such a pressure area for pivoting from the standby position.

In one further exemplary embodiment of the present invention, the operation element in one of these positions has only pressure areas, and in the other position preferably has at least one traction area.

On account thereof, the operation element in terms of the design of the external face thereof in at least the one position is very flat (as no traction areas are present), such that the former presents itself to the user as a substantially smooth surface. This is particularly appealing when the operation element is located in a retracted position in the motor vehicle door.

In one further exemplary embodiment of the present invention, the operation element has a handle portion which in one of these positions lies substantially within the motor vehicle door, or is specified to lie there, and which in the other of these positions projects from the motor vehicle door and is manually grippable, or is more readily grippable than in the one position, or is specified to project accordingly and be grippable or to be more readily grippable.

On account thereof, an operation potential which corresponds to the conventional use (door handle) is provided, while at the same time achieving a more aerodynamic or a more visually appealing other state of a door lock operator having only one component. Preferably, in the position projecting from the motor vehicle door, a rear wall of the handle portion that faces the user is aligned so as to be flush with the surface of the motor vehicle door.

In one further exemplary embodiment of the present invention, the door lock operator, or the motor vehicle door, or a motor vehicle in which the door lock operator is to be or is installed, has a controller unit by means of which the first switch is linked to one function when the operation element is located in one of these positions, and by means of which the first switch is linked to a different function when the operation element is located in the other of these positions.

On account thereof, a plurality of functions may be linked to the switch. That is to say that by way of only one switch two different actions or groups of actions are capable of being carried out. For example, in the one position (for example in the retracted position of the operation element), operating the switch is linked to unlocking the door lock and simultaneously to activating the actuator for deploying the operation element to a position projecting from the motor vehicle door. In the other position (in the projecting position, for example), operating the switch then is linked to opening the door lock, for example, such that the motor vehicle door may be pivoted open. Here, the further switch which in each position is linked to one and the same function, for example, may be present here.

In one further exemplary embodiment of the present function, the further switch by means of the controller unit is linked to a function when the operation element is located in one of these positions, the further switch by means of the controller unit being linked to a different function when the operation element is located in the other of these positions.

On account thereof, a plurality of functions may also be linked to the further switch. That is to say that four different actions or groups of actions are capable of being carried out by way of two switches, for example.

In one further exemplary embodiment of the present invention, the door lock operator, additionally to the first switch, has a mechanical door lock operation installation or a coupling portion for a mechanical operation means of the door lock.

On account thereof, an additional possibility for opening the door is provided such that the probability of a failure of the door lock operator (for example, in the case of an accident) is minimized. The possibility on its own is already a very advantageous aspect of the invention, which, for example in a manner detached from the design embodiment having a pivot arm and the first articulation, may also be the subject matter of a claim in a separate application, for example as a door lock operator which has a manual operation element by means of which the first switch is operable, wherein the first switch is provided to be connected by way of a signal line to an electric door lock such that the electric door lock is operable by way of the first switch, wherein the door lock operator additionally to the first switch has a mechanical door lock operation installation or a coupling portion for a mechanical operation means of the door lock, optionally in combination with the preferred features mentioned hereunder.

A mechanical door lock operation installation has a gear box, for example, (a traction means gear box/a hydraulic gear box/a cam gear box/a linkage gear box, etc., for example) which is connected or connectable to the door lock. A mechanical operation means, for example a Bowden cable, is preferably part of such a gear box. Here, mechanical preferably means that the installation or the operation means, respectively, is operable without an electric current/voltage, thus being particularly suitable as an emergency system.

The coupling portion is preferably a portion which is preferably distinguished from the remaining portions of the door lock operator to the extent that a form-fitting fastening possibility for the operation means is provided here, for example a recess for a nipple of a Bowden traction cable.

Preferably, the mechanical door lock operation installation or the mechanical operation means of the door lock that is coupled to the coupling portion is operable by the user by means of an emergency operation, the door lock thus being mechanically operable by means of the emergency operation. An emergency operation is preferably understood to be an operation which the user may only carry out upon unblocking of the emergency operation possibility. Unblocking here may be, for example: one or a plurality of actions which require(s) a movement direction other than that for operating the emergency operation (for example, opening a cover or withdrawing a safety pin) and/or one or a plurality of actions which require overcoming a maximum resistance (for example, rupturing a default rupture point, releasing a preferably reversible latch or snap-fit mounting, or another kind or latching connection, for example latching by means of a ball in a contour cavity that is pretensioned by way of a spring).

Emergency operation is preferably capable of being carried out by way of the operation element. For example, the operation element is restricted to a specific regular operation range in the case of normal operation (for example, by way of a default-rupture-point-or latching-disposed stop). In order to be operated in an emergency, the operation element is then unblockable by means of increased force (for example, by rupturing the default rupture point or by releasing the latching connection) such that said operation element is movable in an enlarged operation range, the door lock being mechanically operable by movement of the operation element in the enlarged operation range. This may, for example, be designed such that part of the operation element or the latter in its entirety may be "ripped" out, the lock in the case of an emergency then being capable of operation by way of a cable pull, a Bowden able, or an operation bar.

A default rupture point is preferably characterized in that the default rupture point is releasable by applying an enhanced human effort in force, that is to say without any further aiding energy. Particularly preferably, the default rupture point in relation to other regions at least in portions has a reduced material thickness.

Figure 1B:
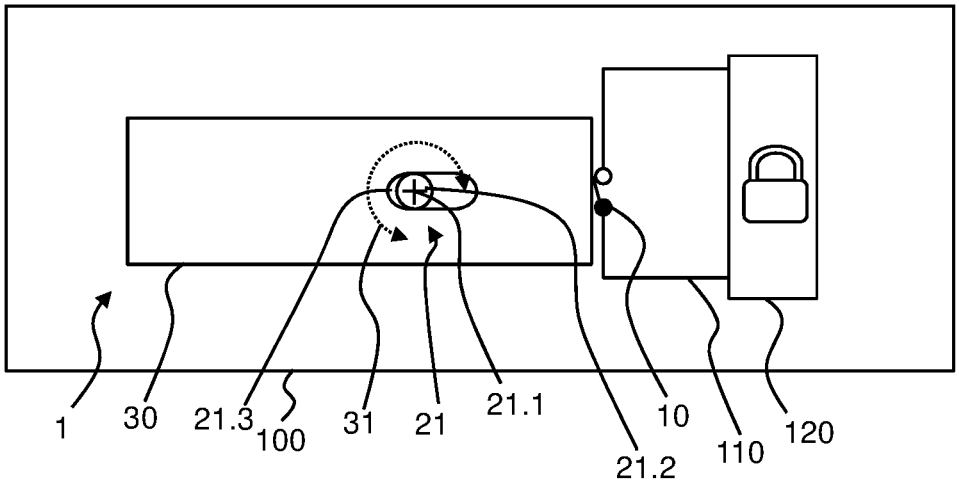
Figure 2A:
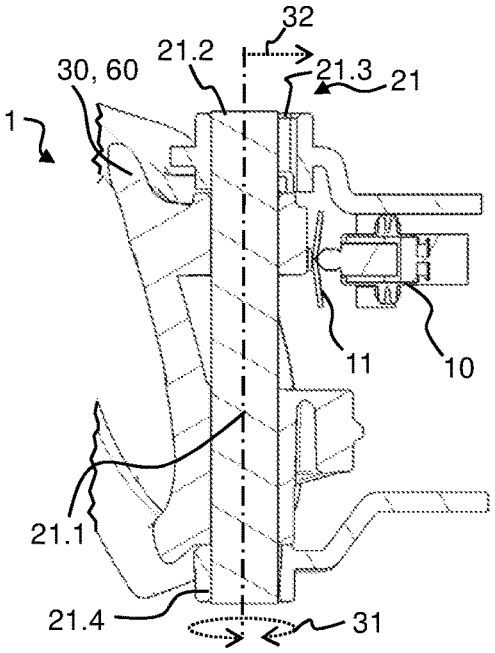
Figure 2B:
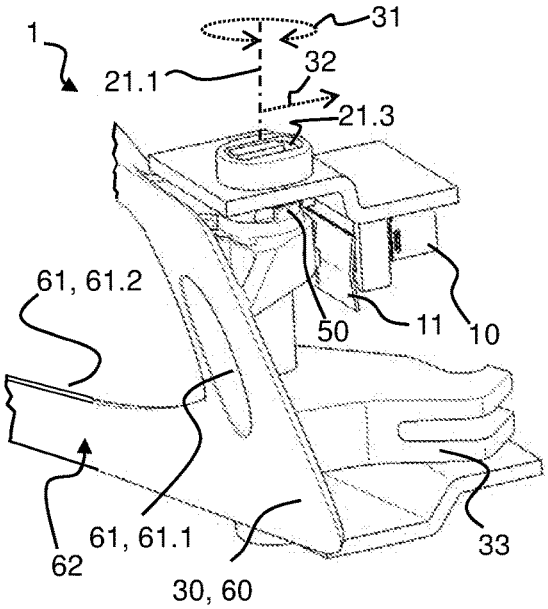
Figure 2C:
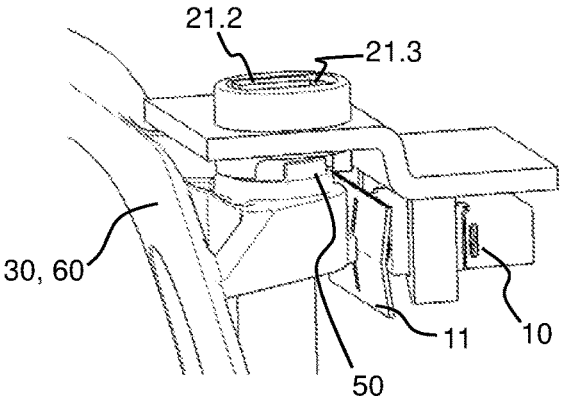
Figure 2D:
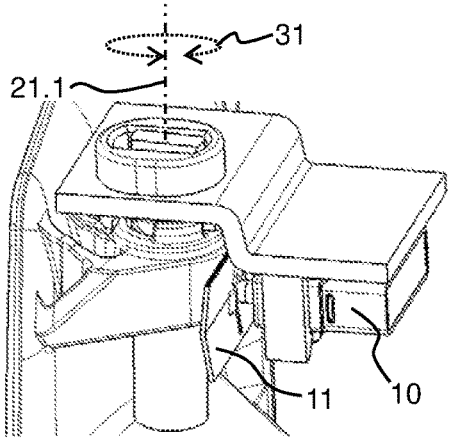
Figure 2E:
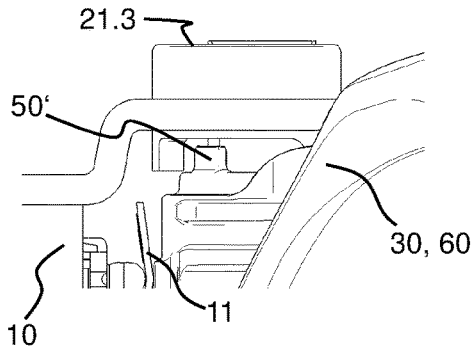
Figure 2F:
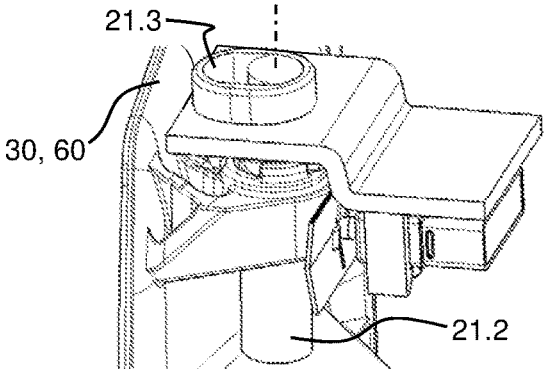

The invention is now to be further visualized in an exemplary manner by means of drawings in which:

FIGS. 1*a*, 1*b* show an in-principle illustration of a door lock operator according to the invention;

FIGS. 2*a-e* show various views of a door lock operator according to the invention. which is conceived as an interior door handle;

FIG. 2*f* shows a variant of a design embodiment of the door lock operator according to FIGS. 2*a-e;*

FIGS. 3*a-d* and 4*a-c* show various views of a door lock operator according to the invention, which is conceived as an external door handle;

FIGS. 5*a*-5*f* show various states of a further door lock operator which in particular has a transmission lever 90.

FIGS. 1*a*, 1*b* show an in-principle illustration of a door handle operator 1 for a motor vehicle door 100. The door lock operator 1 has a first switch 10, and a first pivot arm 30 which is mounted or mountable so as to be pivotable about a first rotation axis 21.1 of a first articulation 21, along a first degree of freedom 31, presently in relation to the motor vehicle door 100. The first pivot arm 30 has a further degree of freedom 32 which is perpendicular to the first rotation axis 21.1. The first switch 10 is operable by way of movement of the first pivot arm 30 along a first direction of the further degree of freedom 32. The first switch 10 is provided to be connected to an electric door lock 120 by way of a signal line 110, such that the electric door lock 120 is operable by way of the first switch 10. These figures furthermore also show the motor vehicle door system having the motor vehicle door 100, the door lock operator 1, and having the door lock 120, wherein the motor vehicle door 100 has the signal line 110 which connects the first switch 10 to the electric door lock 120.

The non-operated state of the door lock operator 1 is shown in FIG. 1*a*. FIG. 1*b* shows the operated state which, proceeding from FIG. 1*a*, is achieved by traversing the first pivot arm 30 to the right, along the further degree of freedom 32.

Furthermore, a preferred design embodiment of the further degree of freedom 32 by means of a mounting in an elongate bore is shown here. To this end, the first articulation 20 has an axle element 21.2 which is guided so as to be traversable in an elongate bore 21.3.

FIGS. 2*a-e*, on the basis of FIGS. 1*a* and 1*b*, show various views of a preferred embodiment of a door lock operator 1 according to the invention, which presently and in an exemplary manner is conceived as an internal door handle, but which may also be designed as an external door handle. FIG. 2*a* shows a section through a front view, FIG. 2*b* shows an oblique perspective view from the left front/above, wherein the first pivot arm is only shown as a fragment, FIG. 2*c* shows an oblique perspective view of a detail of the upper region of the first articulation 21 from the left front and slightly from above, FIG. 2*d* shows a further oblique perspective view of a detail of the upper region of the first articulation 21 from the right front/above, FIG. 2*e* shows a further perspective view of a detail of the upper region of the first articulation 21 from the rear. While FIGS. 2*a*, 2*b*, 2*c*, and 2*e* show the door lock operator 1 in a state in which the first switch 10 is not operated, FIG. 2*d* shows a state in which the first switch 10 is operated.

Along at least a part-region of the first degree of freedom 21, the first pivot arm 30 is impinged by a first spring element 11. The spring element 11 here is a preferred catch spring, coupled to the first switch 10. The first articulation 21 has a pivot arm sided part and a motor vehicle door sided part, the elongate bore 21.3 being present in the motor vehicle door sided part. The axle element 21.2 is a pin which on side is guided in the elongate bore 21.3 so as to be traversable in a manner perpendicular to the first rotation axis 21.1. On another side of the axle element 21.2, the pin is mounted in a bore 21.4 so as not to be traversable in relation to the first rotation axis 21.1. The pin is mounted in a rotationally fixed manner, the first pivot arm 30 being rotatably mounted on the pin.

The door lock operator 1 has two stops 50, 50' which in a pivoted position of the first pivot arm 30 restrict movement of the pivot arm 30 along the further degree of freedom 32 more than in another pivoted position of the first pivot arm 30. The stop 50 beyond a specific outwardly pivoted state of the pivot arm 30 blocks the further degree of freedom. The stop 50' beyond a specific inwardly pivoted state blocks the further degree of freedom. The stops 50, 50' are configured as cams and are disposed on the pivot arm 30. At a specific angular position, said stops 50, 50' move into an intermediate space between the axle element 21.2 and a fixed part on the side of the vehicle door in the elongate bore 21.3, such that the axle element 21.2 cannot be traversed therein.

The first pivot arm 30 has an operation portion which is to be manually pulled and to be manually depressed, the former therefore at the same time being an operation element 60. The operation element 60 in the region of the first articulation 21 has a pressure area 61.1 as an operation area 61, and a handle portion 62 having traction areas 61.2 as an operation area 61.

In addition to the first switch 10, the door lock operator 1 has a coupling portion 33 for a mechanical operation means, presently for a Bowden cable, of the door lock 120. Thus, the operation element 60 by way of a Bowden cable is additionally connected or connectible to the door lock in a conventional manner.

In order for the door lock 120 to be operated, the user may either depress the pressure area 61.1, on account of which the axle element 21.2 within the elongate bore 21.3 is traversed counter to the spring element 11 (to the position shown in FIG. 2*d*) and is thus pivoted in its entirety. On account thereof, the switch 10 is operated. By virtue of the operation of the switch, the door lock 120 is then electrically operated. Additionally, the user may traction the operation element 60 by way of the handle portion 62, thus operating the door lock 120 by way of the Bowden cable. In the case of this design embodiment, enhanced safety (in the case of an accident, for example) is provided by virtue of the redundant mechanical possibility for opening the door.

FIG. 2*f* shows a variant of a design embodiment of the door lock operator 1 according to FIGS. 2*a-e*, in which the axle element 21.2 is guided so as to be traversable and rotatable in the elongate bore 21.3, and on the other side is mounted so as to be rotatable in the other bore. The first pivot arm 30 is mounted on the axle element 21.2 so as to be rotatable or to be rotatably fixed, or has the axle element 21.1 as a component part.

Figure 3A:
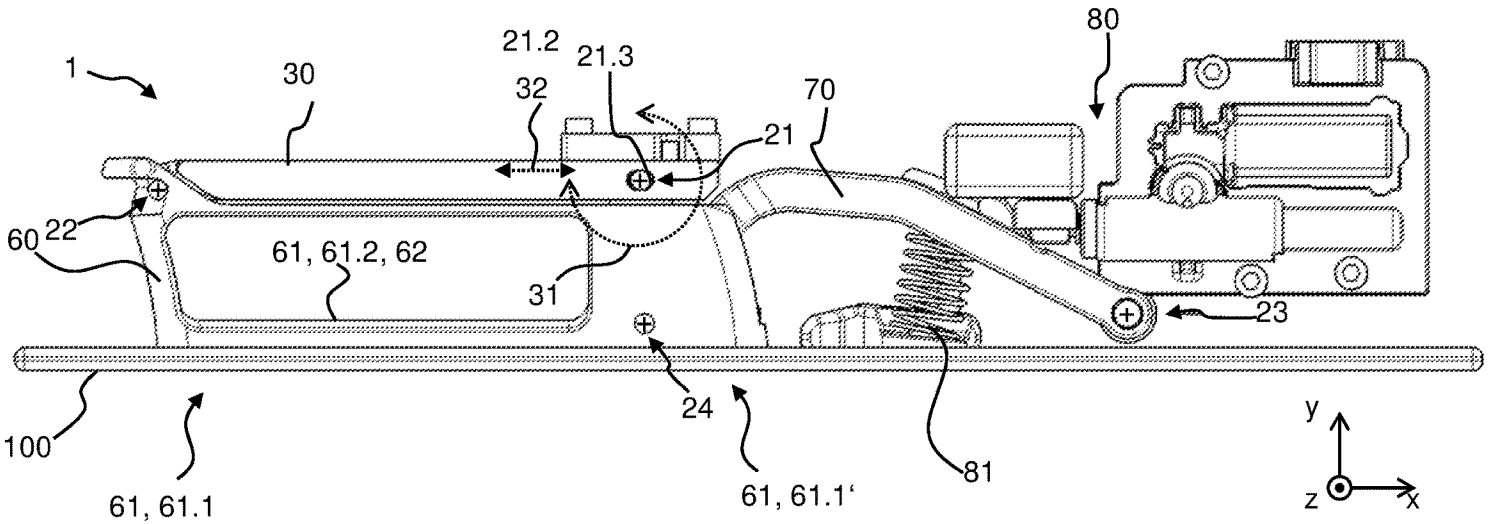
Figure 3B:
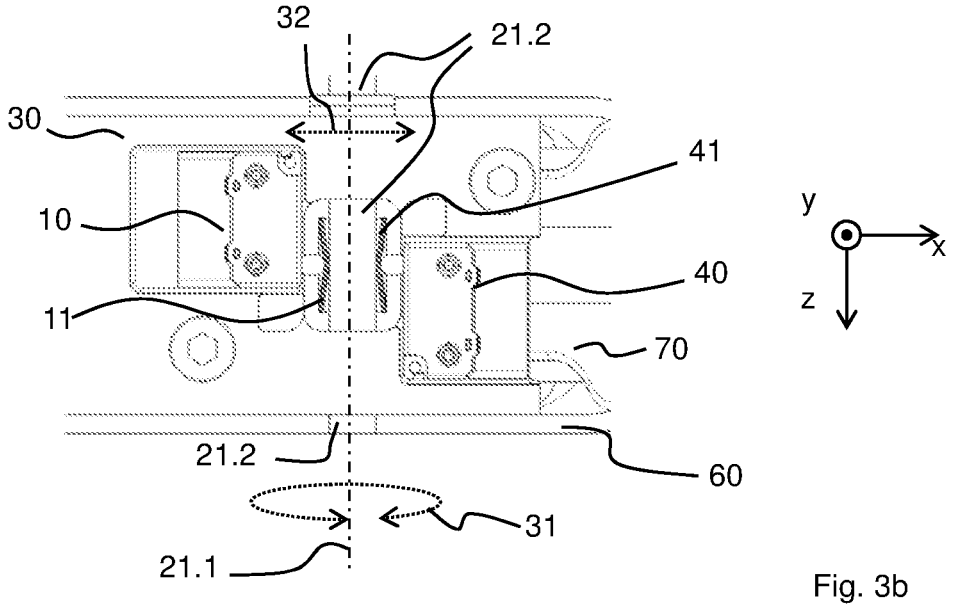
Figure 3C:
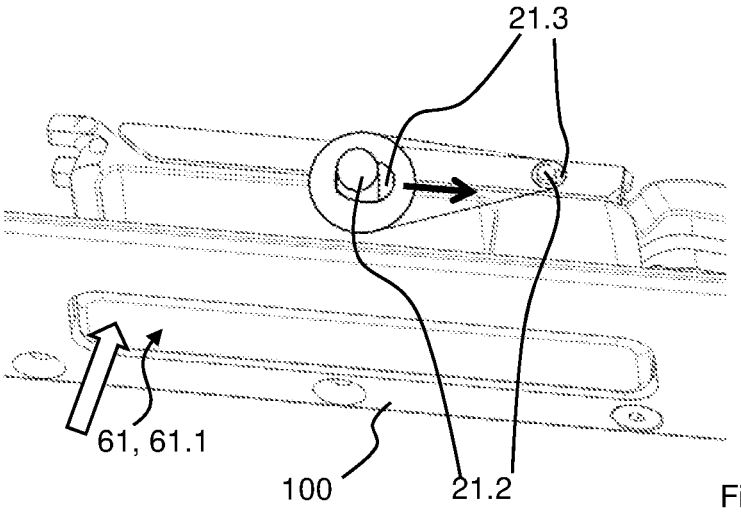
Figure 3D:
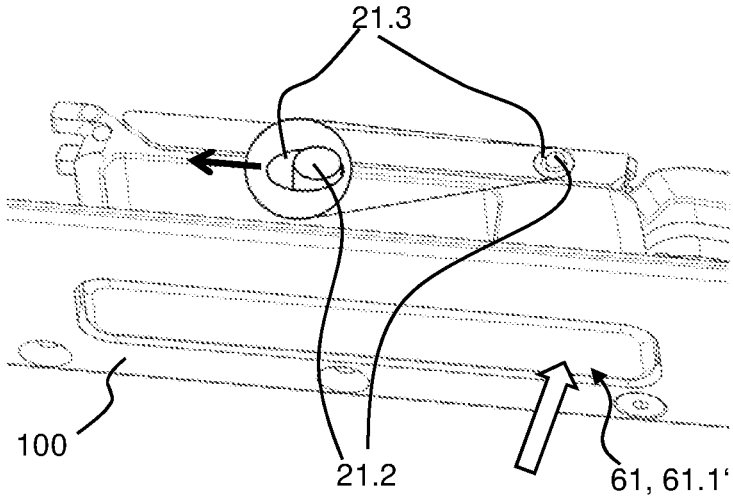
Figure 4A:
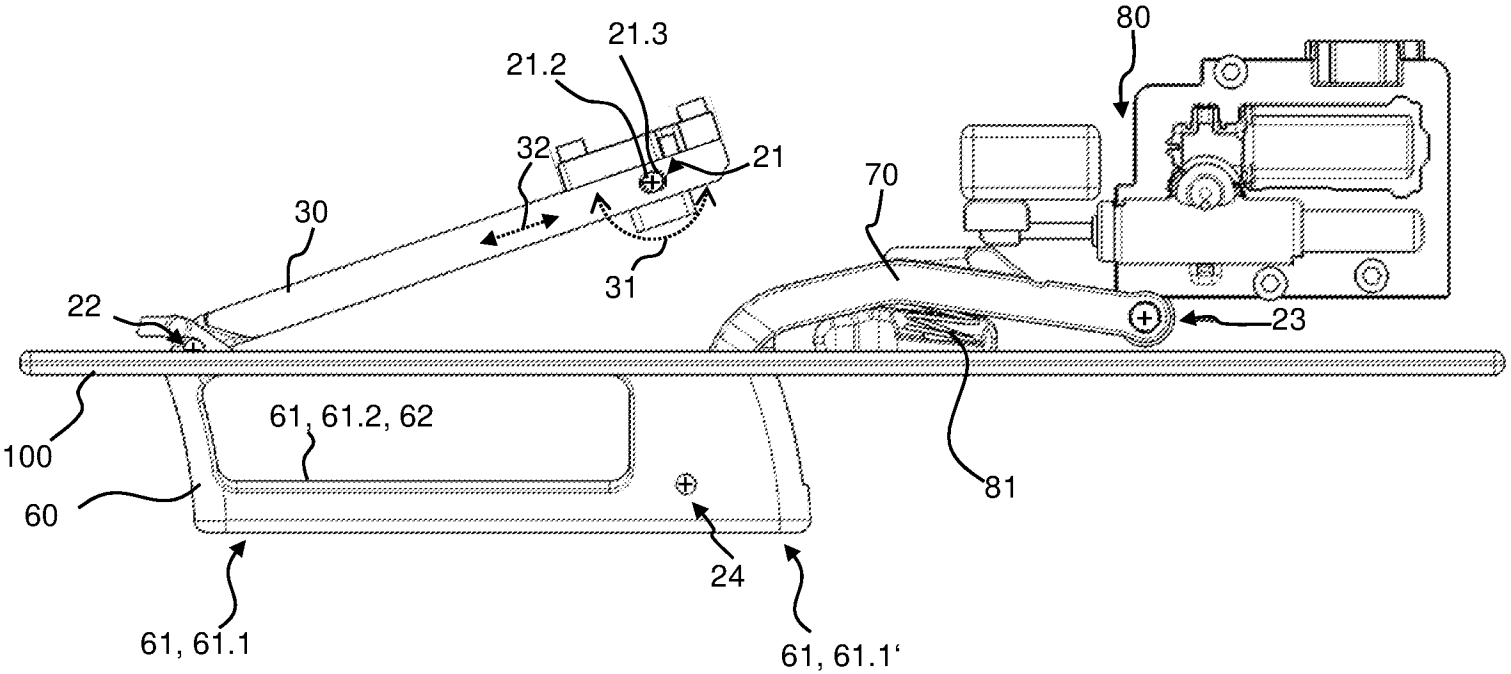
Figure 4B:
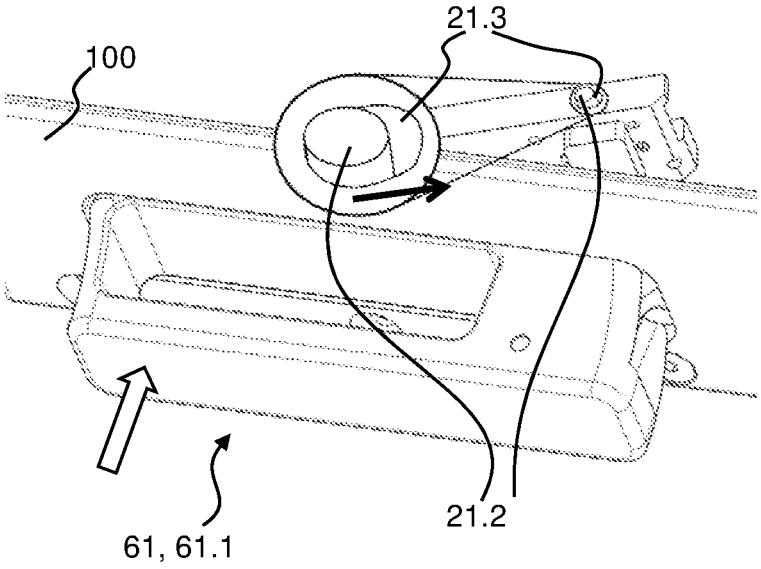
Figure 4C:
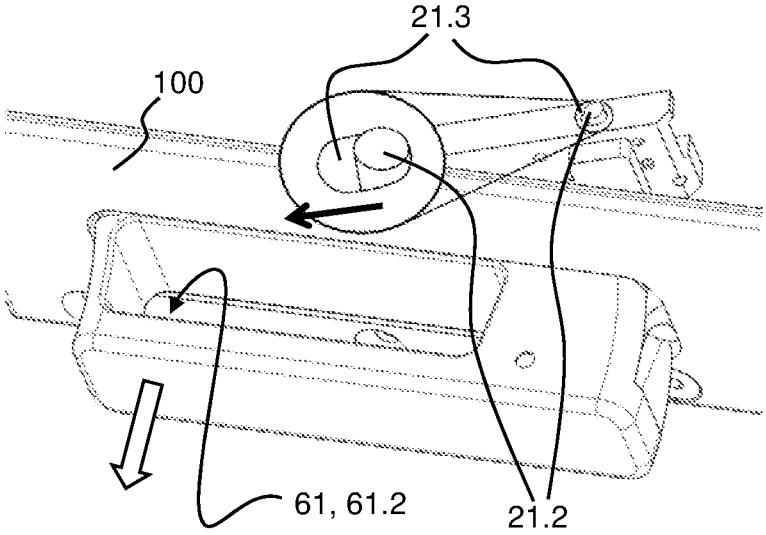

FIGS. 3*a-d* and 4*a-c*, on the basis of FIGS. 1*a* and 1*b*, show various views of a door lock operator 1 according to the invention, which in an exemplary manner is presently conceived as an external door handle, but may also be designed as an internal door handle. FIGS. 3*a*, 3*b*, and 3*d* show the door lock operator 1 in a retracted position of the operation element 60 (see below), while FIGS. 4*a*, 4*b*, and 4*c* show a deployed position. FIG. 3*a* shows a plan view of the door lock operator 1. FIG. 3*b* shows a rear view of the first pivot arm 30 in the region of the first articulation 21. FIGS. 3*c* and 3*d* show the operation of the switch 10 (FIG. 3*c*) or of the switch 40 (FIG. 3*d*), respectively, in the retracted position of the operation element 60, and FIGS. 4*b* and 4*c* show the operation of the switch (FIG. 4*b*) or of the switch 40 (FIG. 4*c*), respectively, in the deployed position of the operation element 60.

The door lock operator 1 has a further switch 40, and the further switch 40 is operable by way of movement of the first pivot arm 40 in a second direction, counter to the first direction, along the further degree of freedom 32. The first pivot arm 30 along a part-region of the first degree of freedom 31 is impinged by a first spring element 11, and along a further part-region of the first degree of freedom 31 is impinged by a further spring element 41, both spring elements 11, 41 here being preferred catch springs and each being coupled to the respective switch 10, 40. Thus, the pivot arm 30 in terms of the freedom of movement thereof in the one direction is limited in a force-dependent manner by the first spring element 11, and in the other direction by the second spring element 40. The first switch 10 and the second switch 40 are locationally fixed in relation to the first pivot arm 30.

The axle element 21.2 is a pin which on one side of the axle element 21.2 in the elongate bore 21.3 is guided so as to be rotatable and traversable in a manner perpendicular to the first rotation axis 21.1, and on another side of the axle element 21.2, differing from FIGS. 2*a-e*, in a further elongate bore is likewise guided so as to be rotatable and traversable in relation to the first rotation axis 21.1. The axle element 21.2 per se is locationally fixed in relation to the motor vehicle door 100.

The door lock operator 1 has a separate operation element 60 having an operation portion which is to be manually gripped and to be manually depressed. The operation element 60 by way of a second articulation 22 is mounted on the first pivot arm 30. The door lock operator 1 has a second pivot arm 70 which by way of a third articulation 23 is mounted or mountable so as to be pivotable in relation to the motor vehicle door 100. The operation element 60 by way of a fourth articulation 24 is mounted on the second pivot arm 70. The second, third, and fourth articulation each are pure rotary joints, the articulation axes of which are substantially parallel with the first rotation axis 21.1. The four articulations 21, 22, 23, 24 form a four bar linkage or a parallelogram linkage, respectively, wherein the respective axes of the first and third articulation 21, 23 are locationally fixed in relation to the vehicle door 100. The first pivot arm 30 along the further degree of freedom 32 by means of rotating movement of the operation element 60 which is performed about the fourth articulation 24 is bidirectionally traversable.

The operation element 60 on either side of the fourth articulation 24 has at least one operation area 61. The operation areas 61 on either side of the fourth articulation 24 presently are pressure areas 61.1, 61.1', and traction areas 61.2.

The operation element 60 by means of an actuator 80 by way of parallel traversing is alternatable between two positions. This is performed by means of rotating the first pivot arm 30 along the first degree of freedom 31. The one position is a position of the operation element 60 in which the latter is retracted into the motor vehicle door 100 (FIGS. 3*a*, 3*c*, 3*d*). The external face of the operation element 60 here terminates so as to be flush with the surface of the motor vehicle door 100. The other position is a position of the operation element 60 in which the latter projects from the motor vehicle door 100 (FIGS. 4*a*, 4*b*, 4*c*). Here, at least one traction area 61.2 is provided for the user for operating the door lock operator 1, and/or for pivoting open the motor vehicle door 100.

The actuator 80, in an exemplary manner, presently has a gear box having a tappet which is linearly traversable and which impinges the second pivot arm 70 counter to a resetting installation 81 (a spring, for example), thus causing the fourth rotary joint 24 to be fixed in the respective position such that the operation element 60 may advantageously be pivoted about the axis of the fourth rotary joint 24 in order to achieve traversing of the first pivot arm 30 along the further degree of freedom 32.

In the retracted position the operation element 60 has only pressure areas 61.1. The operation element 60 has a handle portion 62 which in one of these positions lies within the motor vehicle door 100, and which in the other of these positions projects from the motor vehicle door 100 and is manually grippable. In the position which projects from the motor vehicle door 100, the rear wall of the handle portion is flush with the surface of the motor vehicle door.

The further degree of freedom 32 of the first pivot arm 30 is present in two mutually opposite directions in each of the two positions. As is shown in FIG. 3*c*, the first switch 10 may be operated by depressing the pressure surface 61.1 in the retracted position of the operation element 60; as is shown in FIG. 3*d*, the further switch 40 may be operated in the opposite direction by depressing on the pressure area 61.1' in the retracted position of the operation element 60. As is shown in FIG. 4*b*, the first switch 10 may be operated as before by depressing the pressure area 61.1 in the deployed position of the operation element 60, and, as is shown in FIG. 4*c*, the further switch 40 may be operated in the opposite direction by tractioning the traction area 61.2.

A design embodiment in which the first articulation 21, which has the further degree of freedom 32, mounts the first pivot arm 30 in relation to the motor vehicle door is shown in FIGS. 3*a* to 4*c*. Alternatively, however, another of the four articulations may have the further degree of freedom 32, for example the articulation 23 which then in the context of the claims may be considered to be the "first" articulation, or in an analogous manner the articulations 22 or 24. Depending on the case, the pivot arm which is presently referenced as 70 is to be considered the first pivot arm in the context of the claims, and the pivot arm which is presently referenced as 30 is to be considered to be the second pivot arm.

Figure 5A:
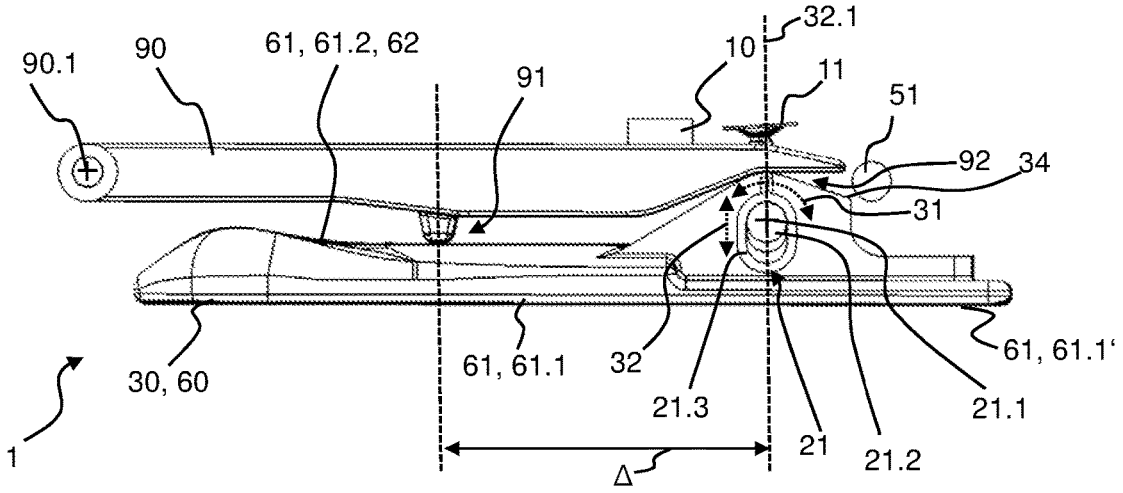
Figure 5B:
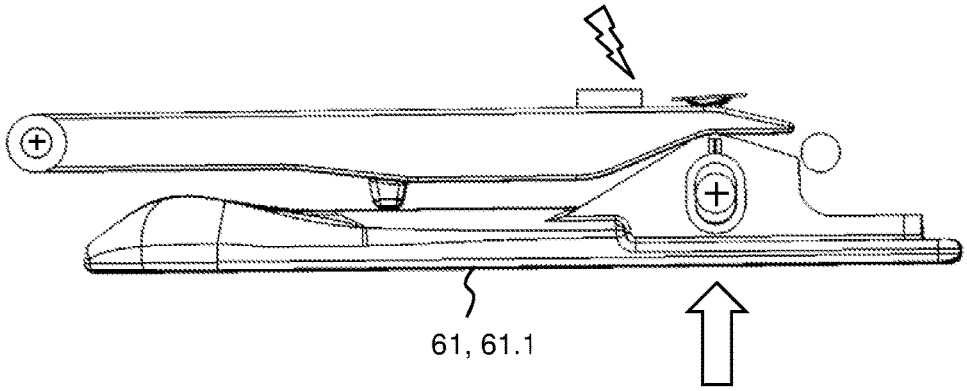
Figure 5C:
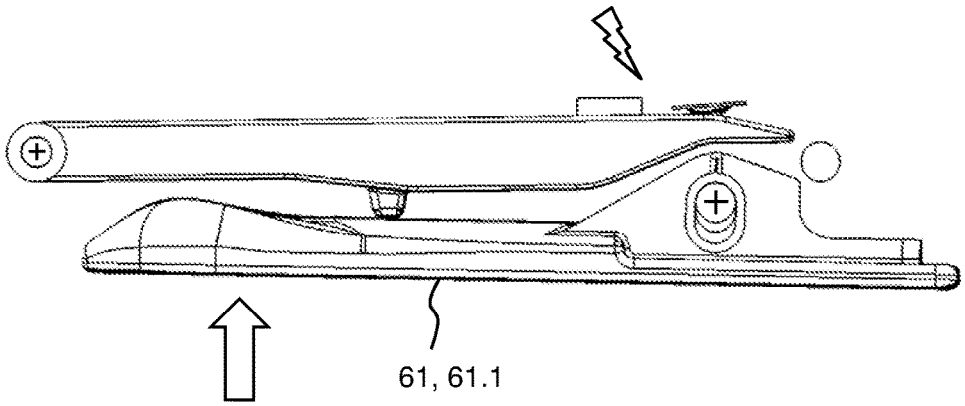
Figure 5D:
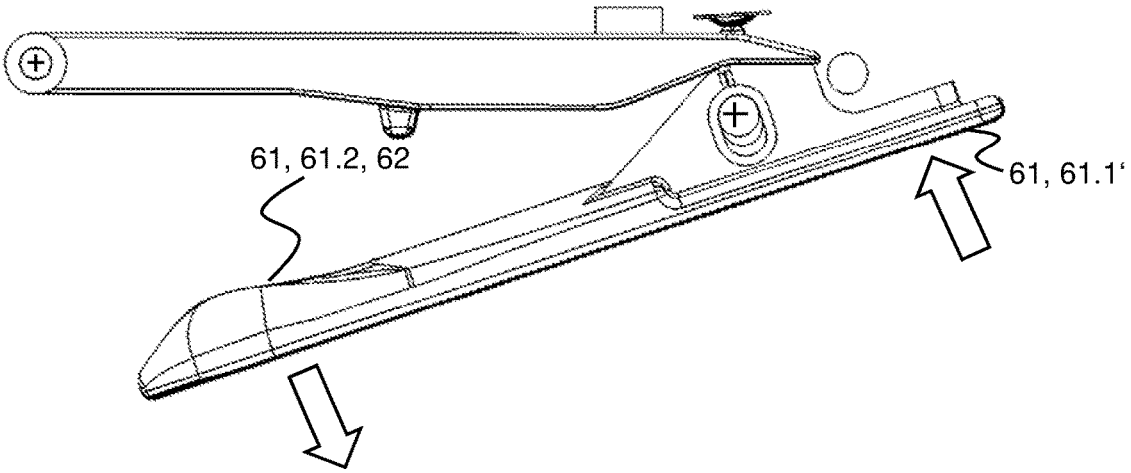
Figure 5E:
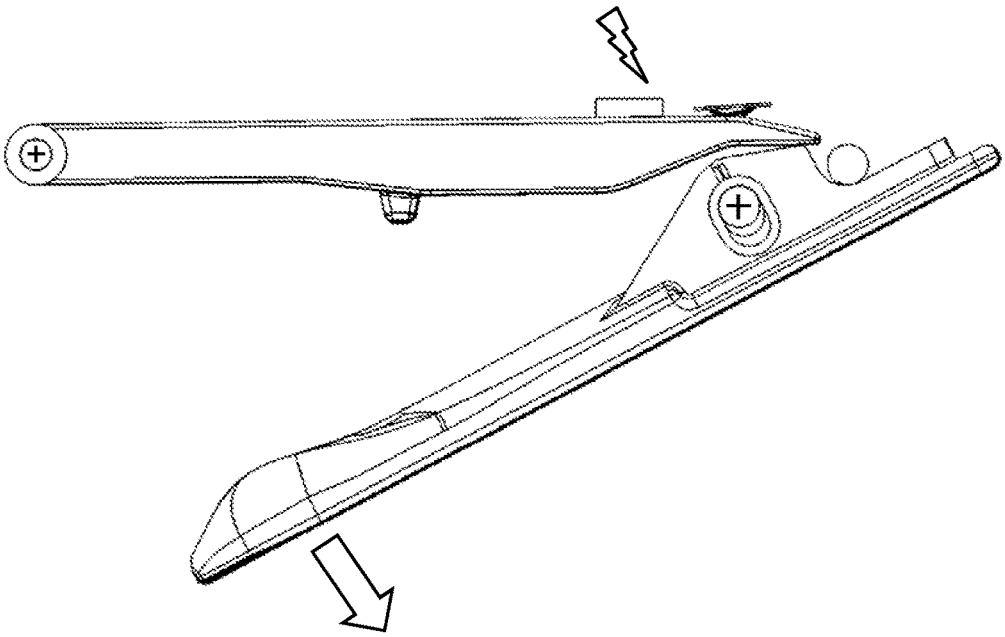
Figure 5F:
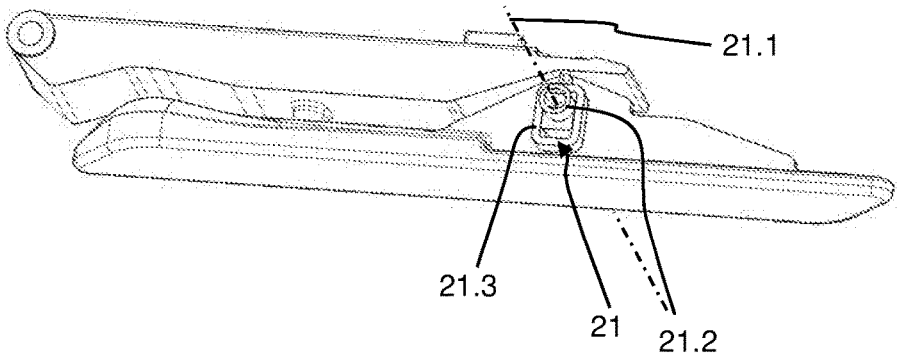

FIGS. 5*a*-5*f*, on the basis of FIGS. 1*a* and 1*b*, show various state of a further door lock operator 1 which in particular has a transmission lever 90. The latter, by way of rotation axis 90.1 which is aligned so as to be parallel with the rotation axis 21.1, is likewise rotatably mounted. The first pivot arm 30 and the transmission lever 90 here are disposed so as to be reciprocal, that is to say that the transmission lever 90 from the rotation axis 90.1 extends substantially in the direction of the rotation axis 21.1, and that the first pivot arm 30 from the rotation axis 21.1 extends substantially in the direction of the rotation axis 90.1. Moreover, the first pivot arm 30 and the transmission lever 90 are mutually overlapping. The transmission lever 90 lies between the switch 10 and the first pivot arm 30, in particular in relation to at least one transmission of force from the pivot arm 30 to the switch 10. The first switch 10 is operable by way of pivoting the first pivot arm 30 along a first direction of the first degree of freedom 31 (FIG. 5*e*). To this end, the first pivot arm 30 in the region of the first articulation 21 has an eccentric contour 34 which operates the switch 10 beyond a predefined specific pivoted angle, in the present example by way of the transmission lever 90 as a force/torque transmitter. The first pivot arm 30 along at least a part-region of the first degree of freedom 32 is indirectly impinged by a first spring element 11. In the case of this device it is preferable for the axle element 21.1 on one side of the axle element 21.2 to be guided in the elongate bore 21.3 so as to be traversable in a manner substantially perpendicular to the first rotation axis 21.1, and on another side of the axle element 21.2 to be guided in a further elongate bore, or in the same elongate bore which however is extended up to the other side, so as to be linearly traversable in a manner substantially perpendicular to the first rotation axis 21.1. The door lock operator 1 has a pivotably mounted transmission lever 90 which impinges the first switch 10, and which by the first pivot arm 30 by pivoting the first pivot arm 30 and/or by the movement of the first pivot arm 30 along the first direction of the further degree of freedom 32 is impingeable in such a manner that, on account thereof, the first switch 10 is operable by means of the transmission lever 90. The door lock operator 1 between the first pivot arm 30 and the transmission lever 90 has a transmission contact region 91 in which the first pivot arm 30 and the transmission lever 90 bear on one another. The transmission contact region 91 from an imaginary line 32.1 through the first rotation axis 21.1, which is parallel or collinear with the further degree of freedom 32, has a spacing Δ. Moreover, a further transmission contact region 92 is present between the first pivot arm 30 and the transmission lever 90, the former being separated from the first transmission contact region 91 by a region in which there is no contact between the first pivot arm 30 and the transmission lever 90. The first pivot arm 30 bears on the transmission lever in these transmission contact regions 91, 92. Preferably, the first pivot arm 30 is urged against the transmission lever 90 by means of a spring element. The transmission contact region 91 is formed half-way between the rotation axis 90.1 and the rotation axis 21.1, on account of which advantageous uniformity of the required pressure force along the pressure area 61.1 results. The closer the transmission contact region 91 is displaced from here toward the rotation axis 21.1, the lower the required pressure force for operating the switch at the left end of the first pivot arm 30, that is to say that end that faces the rotation axis 90.1. In order of the transmission contact region to be defined, the transmission lever 90 has a protrusion which faces the first pivot arm 30. The second transmission contact region 92 is formed so as to be level in height with the rotary joint 21. The first pivot arm 30 has an operation portion that is to be manually pulled and/or to be manually depressed, the former thus at the same time being an operation element 60. The operation element 60 is manually and preferably by means of an optional actuator 80 alternatable between at least two positions. The operation element 60 has a pressure area 61.1' which is to be manually depressed, the operation element 60 by way of manual pressure on this pressure area 61.1' being manually pivotable from one of these two positions, the one of these two positions being a standby position of the operation element 60. The operation element 60 has a handle portion 62. The latter in one of these positions preferably lies substantially within the motor vehicle door 100, or is specified to lie therein. In the other of these positions, said handle portion 62 projects from the motor vehicle door 100, and is at least manually more readily grippable than in the one position. A stop 51 serves as an overload protector (FIG. 5*e*). While FIGS. 5*a*-5*e* are plan views, FIG. 5*f* shows an oblique view from slightly above; here, only the elongate bore 21.3 is more angular and less oval than in FIGS. 5*a*-5*e*, and lengths of levers are different; otherwise, this embodiment shown is analogous to those of FIGS. 5*a*-5*e*. The articulation 21 has an axle element 21.2 which is disposed so as to be rotationally fixed in the elongate bore 21.3, but is linearly traversable. The first pivot arm, for example by way of an actuator, may thus be torsioned by means of rotating the axle element 21.1 which is rotatably disposed in a housing (not shown).

The various operation potentials resulting therefrom will now be described by means of FIGS. 5*b*-5*e*, switching of the switch 10 being in each case indicated by means of a small lightning flash. Commencing directly from the standby position of the operation element 60 (FIG. 5*a*), the switch 10 is operable by means of a pressure force in the region of the first articulation 21 (FIG. 5*b*) up to that end of the operation element 60 (FIG. 5*c*) that faces away from the pressure area 61.1', thus serving as a wide pushbutton. In the case of FIG. 5*b*, transmission of force from the first pivot arm 30 to the transmission lever 90 is increasingly performed by way of the transmission contact region 92, in the case of FIG. 5*c* increasingly by way of the transmission contact region 91. Furthermore, commencing from the standby position of the operation element 60 (FIG. 5*a*), the operation element 60 may be moved out of the standby position thereof to a projecting position (FIG. 5*d*) in that a manual pressure force is applied to the area 61.1', or in that a traction force is applied to the area 61.2 (to the extent that the latter is grippable) of the handle portion 62. Moreover, it is possible for an actuator to be coupled to the first pivot arm 30 to this end. Here, the first pivot arm 30 in the transmission contact region 91 is raised from the transmission lever 90. The switch 10 is then operable also from the position shown in FIG. 5*d*, in the simplest manner by means of continuing traction engaging on the area 61.2 (FIG. 5*e*).

A new door lock operator which offers a large variety of employment possibilities for operating a door lock has been proposed herein. This is possible in particular by virtue of an articulation which has two degrees of freedom, a switch by way of which the door lock is operable or is operated, respectively, being operated by way of at least one of these degrees of freedom. The articulation here may serve directly as a mounting for an operation element, for example, (an internal door handle, for example), or be part of a complex gearbox, in particular of a four bar linkage, for example, which permits very comfortable and at the same time aerodynamic or protected (against dust/dirt/damage) positioning of an operation element.

| List of reference signs | |
|---|---|
| 1 | Door lock operator |
| 10 | First switch |
| 11 | First spring element |
| 21 | First articulation |
| 21.1 | Rotation axis of the first articulation |
| 21.2 | Axle element |
| 21.3 | Elongate bore |
| 21.4 | Bore |
| 22 | Second articulation |
| 23 | Third articulation |
| 24 | Fourth articulation |
| 30 | First pivot arm |
| 31 | First degree of freedom |
| 32 | Further degree of freedom |
| 32.1 | Line parallel or collinear with the further degree of freedom through the first rotation axis |
| 33 | Coupling portion |
| 34 | Eccentric contour |
| 40 | Further switch |
| 41 | Further spring element |
| 50 | Stop |
| 51 | Stop |
| 60 | Operation element |
| 61 | Operation area |
| 61.1 | Pressure area |
| 61.2 | Traction area |
| 62 | Handle portion |
| 70 | Second pivot arm |
| 80 | Actuator |
| 81 | Resetting installation |
| 90 | Transmission lever |
| 90.1 | Rotation axis |
| 91 | Transmission contact region |
| 92 | Transmission contact region |
| 100 | Motor vehicle door |
| 110 | Signal line |
| 120 | Electric door lock |
| Δ | Spacing |

The invention claimed is:

1. A door lock operator (1) for a motor vehicle door (100), wherein the door lock operator (1) has a first switch (10) and an operating pivot arm (30) which is mounted or mountable so as to be pivotable about a first rotation axis (21.1) of an articulation (21) along a first degree of freedom (31), wherein the operating pivot arm (30) has a further degree of freedom (32) which is substantially perpendicular to the first rotation axis (21.1), and the first switch (10) is operable by way of movement of the operating pivot arm (30) along a first direction of the further degree of freedom (32), wherein the first switch (10) is provided to be connected by way of a signal line (110) to an electric door lock (120) such that the electric door lock (120) is operable by the first switch (10);

wherein, the articulation (21) comprises an elongate bore (21.3) that receives an axle element (21.2)

therein, wherein the operating pivot arm is mounted to the axle element, wherein the axle element defines the first rotation axis;

wherein, the elongate bore and the axle element define the first degree of freedom and the further degree of freedom, allowing the first switch to be operated by way of movement of the operating pivot arm in both the first degree of freedom and the further degree of freedom.

2. The door lock operator (1) as claimed in claim 1, wherein the door lock operator has a further switch (40), and the further switch (40) by way of movement of the operating pivot arm (30) is operable along the further degree of freedom (32) in a second direction which is counter to the first direction.

3. The door lock operator (1) as claimed in claim 1, wherein the door lock operator (1) has a stop (50) which in a pivoted position of the operating pivot arm (30) restricts movement of the operating pivot arm (30) along the further degree of freedom (32) more than in another pivoted position of the operating pivot arm (30).

4. The door lock operator (1) as claimed in claim 1, wherein the first switch (10) is locationally fixed in relation to the operating pivot arm (30).

5. The door lock operator (1) as claimed in claim 1, wherein the door lock operator (1) has a pivotably mounted transmission lever (90) which impinges the first switch (10) and which by pivoting the operating pivot arm (30) and/or by the movement of the operating pivot arm (30) along the first direction of the further degree of freedom (32) is impingeable by the operating pivot arm (30) in such a manner that, on account thereof, the first switch (10) is operable by means of the transmission lever (90).

6. The door lock operator (1) as claimed in claim 5, wherein the door lock operator (1) between the operating pivot arm (30) and the transmission lever (90) has a transmission contact region (91) in which the operating pivot arm (30) and the transmission lever (90) bear on one another, wherein the transmission contact region (91) has a spacing (Δ) from an imaginary line (32.1) through the first rotation axis (21.1) the line (32.1) being parallel or collinear with the further degree of freedom (32).

7. The door lock operator (1) as claimed in claim 1, wherein the operating pivot arm (30) has an operation portion which is to be manually pulled or to be manually depressed, and which is therefore at the same time an operation element (60).

8. The door lock operator (1) as claimed in claim 1, wherein the door lock operator (1) has an operation element (60) having an operation portion which is to be manually gripped or to be manually depressed, and a second articulation (22), wherein the operation element (60) by way of the first articulation (21) is mounted on the first pivot arm (30), thus providing pivotability of the first pivot arm (30) along the first degree of freedom (31) about the first rotation axis (21.1) in relation to the operation element (60), and wherein the first pivot arm (30) by way of the second articulation (22) is directly or indirectly mounted or mountable on the motor vehicle door (100);

wherein the door lock operator (1) has a second pivot arm (70) which by way of a third articulation (23) is mounted or mountable so as to be pivotable in relation to the motor vehicle door (100), and wherein the operation element (60) by way of a fourth articulation (24) is mounted on the second pivot arm (70);

wherein the operation element (60) by means of an actuator (80) is alternatable between two positions.

9. The door lock operator (1) as claimed in claim 8, wherein the operation element (60) has a pressure area (61.1') which is to be manually depressed, wherein the operation element (60) by manual pressure on this pressure area (61.1') is manually pivotable from one of these two positions, the one of these two positions being a standby position of the operation element (60).

10. The door lock operator (1) as claimed in claim 8, wherein the operation element (60) has a handle portion (62) which in one of these positions lies substantially within the motor vehicle door (100), or is specified to lie there, and which in the other of these positions projects from the motor vehicle door (100) and is manually grippable, or is more readily grippable than in the one position, or is specified to project accordingly and be grippable or to be more readily grippable.

11. The door lock operator (1) as claimed in claim 8, wherein the door lock operator (1), or the motor vehicle door, or a motor vehicle in which the door lock operator (1) is to be or is installed, has a controller unit by means of which the first switch (10) is linked to one function when the operation element (60) is located in one of these positions, and by means of which the first switch (10) is linked to a different function when the operation element (60) is located in the other of these positions.

12. The door lock operator (1) as claimed in claim 1, wherein the door lock operator (1), additionally to the first switch (10), has a mechanical door lock operation installation or a coupling portion (33) for a mechanical operation means of the door lock (120).

13. A motor vehicle door system having a motor vehicle door (100) and a door lock operator (1) as claimed in claim 1, and having a door lock (120), wherein the motor vehicle door system has a signal line (110) which connects the first switch (10) to the electric door lock (120), or a motor vehicle having such a motor vehicle door system.

14. A door lock operator for a motor vehicle door (100), wherein the door lock operator (1) has a first switch (10) and an operating pivot arm (30) which is mounted or mountable so as to be pivotable about a first rotation axis (21.1) of an articulation (21) along a first degree of freedom (31), wherein the operating pivot arm (30) has a further degree of freedom (32) which is substantially perpendicular to the first rotation axis (21.1), and the first switch (10) is operable by way of movement of the operating pivot arm (30) along a first direction of the further degree of freedom (32), wherein the first switch (10) is provided to be connected by way of a signal line (110) to an electric door lock (120) such that the electric door lock (120) is operable by the first switch (10); wherein the articulation (21) comprises an axle element (21.2) and an elongate bore (21.3), wherein the axle element defines the first rotation axis, wherein the axle element guided so as to be traversable in the elongate bore (21.3) enabling the further degree of freedom.

15. The door lock operator (1) as claimed in claim 14, wherein the first articulation (21) has a pivot arm sided part and a motor vehicle door sided part, the elongate bore (21.3) being present in the motor vehicle door sided part.

16. The door lock operator (1) as claimed in claim 14, wherein the axle element (21.2) on one side of the axle element (21.2) is guided in the elongate bore (21.3) so as to be traversable in a manner substantially perpendicular to the first rotation axis (21.1), and on another side of the axle element (21.2) is mounted so as not to be traversable in relation to the first rotation axis (21.1) along the further degree of freedom (23).

17. The door lock operator (1) as claimed in claim 14, wherein the axle element (21.2) on one side of the axle element (21.2) is guided in the elongate bore (21.3) so as to be traversable in a manner substantially perpendicular to the first rotation axis (21.1), and on another side of the axle element (21.2) is guided in a further or the same elongate bore so as to be traversable in a manner substantially perpendicular to the first rotation axis (21.1).

18. The door lock operator as claimed in claim 14, wherein the operating pivot arm is mounted to rotate about or with the axle element, enabling movement of the operating pivot arm in the first degree of freedom for operating the first switch, and the traversal of the axle element in the elongate bore enables movement of the operating pivot arm in the further degree of freedom for operating the first switch.

* * * * *